US007938044B2

(12) United States Patent
Ensign

(10) Patent No.: US 7,938,044 B2
(45) **Date of Patent: *May 10, 2011**

(54) LOCKING SCREW DRIVER HANDLE

(75) Inventor: Michael D. Ensign, Salt Lake City, UT (US)

(73) Assignee: Alphatec Spine, Inc., Carlsbad, CA (US)

( * ) Notice: Subject to any disclaimer, the term of this patent is extended or adjusted under 35 U.S.C. 154(b) by 70 days.

This patent is subject to a terminal disclaimer.

(21) Appl. No.: 12/187,590

(22) Filed: Aug. 7, 2008

(65) Prior Publication Data

US 2009/0038446 A1 Feb. 12, 2009

Related U.S. Application Data

(60) Provisional application No. 60/954,453, filed on Aug. 7, 2007.

(51) Int. Cl.
*B25B 13/28* (2006.01)
*B25B 23/10* (2006.01)

(52) U.S. Cl. ..... 81/90.2; 81/112; 81/90.9; 81/453

(58) Field of Classification Search ..... 81/90.2–90.9, 81/443, 453, 455, 444, 112, 116, 451
See application file for complete search history.

(56) References Cited

U.S. PATENT DOCUMENTS

| | | | | |
|---|---|---|---|---|
| 203,581 | A * | 5/1878 | Birch | 81/112 |
| 2,297,174 | A * | 9/1942 | Tabb et al. | 81/112 |
| 2,579,438 | A * | 12/1951 | Longfellow | 81/453 |
| 2,592,098 | A * | 4/1952 | Grant | 81/112 |
| 4,363,250 | A * | 12/1982 | Suga | 81/453 |
| 5,207,678 | A | 5/1993 | Harms et al. | |
| 5,690,006 | A | 11/1997 | Pulliam | |
| 6,116,123 | A | 9/2000 | Chen | |
| 7,073,415 | B2 | 7/2006 | Casutt et al. | |
| 2008/0041196 | A1 * | 2/2008 | Companioni et al. | 81/453 |
| 2010/0030278 | A1 * | 2/2010 | Hawkes et al. | 81/90.2 |

FOREIGN PATENT DOCUMENTS

| | | | |
|---|---|---|---|
| JP | 2002337058 | A1 | 11/2002 |
| KR | 200165913 | Y1 | 2/2000 |

* cited by examiner

*Primary Examiner* — Hadi Shakeri
(74) *Attorney, Agent, or Firm* — Michael R. Shevlin

(57) ABSTRACT

A driver including a handle, lever, swivel cap, shaft, and a tip mechanically connected to the lever configured to engage a screw. Engaging the lever causes the tip to either compress or expand so as to lock the screw to the driver. According to one exemplary embodiment, the cap can be translated releasing the lever, thereby releasing the screw from the tip. According to one embodiment, the cap is a swivel cap allowing for jeweler style use. Advantages of the present system and method, according to various embodiments, include a tip compressing a feature that is within an outer diameter of the screw allowing a driver, or a portion thereof, to have a maximum diameter equal to or smaller than the maximum diameter of a screw.

18 Claims, 8 Drawing Sheets

LOCKING SCREW DRIVER HANDLE

RELATED APPLICATIONS

The present application claims the benefit under 35 U.S.C. §119(e) of U.S. Provisional Patent Application No. 60/954,453 filed Aug. 7, 2007 titled "Locking Screw Driver Handle," which application is incorporated herein by reference in its entirety.

FIELD

The present exemplary system and method relate to locking screwdrivers. More particularly, the present system relates to a driver capable of locking onto various fasteners including screws, nuts, bolts, etc. The present exemplary system and method also includes a driver and corresponding screw wherein the driver locks onto features that are located within the outer diameter of the screw head, especially in surgical implant applications.

BACKGROUND

In the surgical treatment of various conditions, including the treatment of fractures, tumors, and degenerative conditions, it is often desired to utilize bone screws to secure and stabilize segments of the body. Many such conditions require a practitioner to insert one or more screws into a patient and/or a medical apparatus. As used in the present specification, and the appended claim, the term "screw" should be interpreted broadly to include any number of fastener devices including, but in no way limited to, a screw, a nut, a bolt, or any other fastener used for securing one or more inter-body elements.

During a number of procedures, it is desirable to secure a medical apparatus, such as a bone plate, a rod, or a tulip assembly, to a patient's bone. Traditionally, a bone screw is used to secure such an apparatus to the patient's bone. A bone screw can vary widely in design and may be configured for a specific application. However, a screw typically includes a threaded shaft and a head, wherein the head contains driving features. The driving features located on the head of a screw are configured to be engaged by the tip of a mating driving instrument. The driving instrument can, via the interaction, drive the screw downward as the threaded shaft of the screw is configured to enter into the desired location and retain the screw therein.

While many traditional screw drivers and screw combinations have been developed, there is a need for a driving instrument capable of locking onto the head of a screw, being able to drive the screw, and subsequently releasing the screw. More particularly, in minimally invasive surgery (MIS) techniques there is a need for a driving instrument capable of driving a screw in a manner most conducive to minimally impacting the surrounding tissue.

SUMMARY

According to one exemplary embodiment, the present system and method includes a driving instrument including a handle, a shaft, and a tip. The handle is configured with a lever, which when actuated, causes the tip of the instrument to lock onto the head of a corresponding screw. With the instrument locked onto the screw, the screw can be driven into a desired location. According to one exemplary embodiment, the handle includes an upper portion (a cap) configured to swivel independently from the rest of the driving instrument.

The cap is configured to provide jeweler style driving; that is, a constant pressure can be applied downward from the cap while the driving instrument is rotated, thereby providing a consistent downward force while driving the screw into the desired location.

According to one exemplary embodiment, the cap can be translated away from the handle portion in order to release the lever and thereby release the tip from the head of screw. Consequently, during operation, the driver can be removed once the screw has been driven into the desired location.

According to another exemplary embodiment, a screw is specifically configured to include a driving feature within the outer diameter of the head of the screw. In such an embodiment, a tip of the driving instrument compresses or frictionally connects with features that are located within the outer diameter of the screw head. This allows the tip and shaft of the driving instrument to lock onto the screw securely while having a diameter at least as small as the diameter of the head of the screw. This feature is particularly useful in minimally invasive surgery (MIS).

According to one exemplary embodiment, the driving instrument may be configured with various tips, each tip being configured to mate with a corresponding screw driving feature. Such common driving features include, but are in no way limited to, Philips (cross-head), slot, Pozidriv, hexagonal (Allen Key), Robertson (square), Torx, Tri-Wing, and hexalobe. According to alternative exemplary embodiments, the tip of the driving instrument is configured to engage and lock onto the outer perimeter of the head of standard fasteners. In short, the present exemplary system and method can be adapted for use with any traditional or non-traditional screw, nut, bolt, or other fastener. Of particular interest and novelty are those driver/screw combinations that allow the tip of the driver to lock onto the screw by compressing or grabbing a feature located within the outer diameter of the screw head. Specific details are provided below.

BRIEF DESCRIPTION OF THE DRAWINGS

The accompanying drawings illustrate various exemplary embodiments of the present system and method and are a part of the specification. Together with the following description, the drawings demonstrate and explain the principles of the present system and method. The illustrated embodiments are examples of the present system and method and do not limit the scope thereof.

Figure 1A:
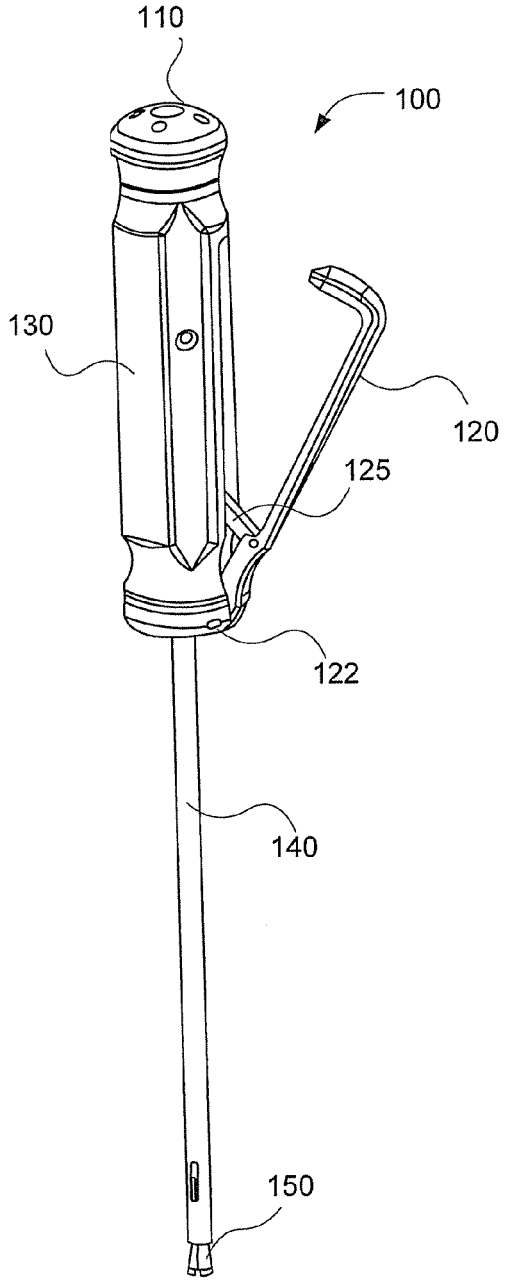
FIG. 1A is a perspective view of a driving instrument, according to one exemplary embodiment.

In the drawings, identical reference numbers identify similar, though not necessarily identical elements or features. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings. Throughout the drawings, identical reference numbers designate similar but not necessarily identical elements.

DETAILED DESCRIPTION

The present specification describes a system and a method for locking a driver to a screw and thereafter driving the screw into a desired location prior to release of the screw. According to one exemplary embodiment, a system includes a driving instrument (driver) comprising a swivel cap, a handle, a lever, a shaft, and a tip configured to be mated with a screw. According to various exemplary embodiments, the tip of the driver is configured to lock onto the head of a screw. Specifically, according to one exemplary embodiment, a system is provided including a driver having a tip configured to lock onto the head of a screw by compressing or frictionally engaging a driving feature located within the outer diameter of the head of the screw. According to alternative embodiments, the tip of the driver is configured to be mated with various common driving features located on the head of common fasteners, e.g. Philips head. According to various alternative embodiments described below, the tip is configured to lock onto the driving features of a screw by compressing the driving features. Alternatively, the tip may be configured to expand and thereby engage and lock onto the driving features of the screw.

Whether configured to lock by compressing or expanding, the exemplary driver may then be rotated to impart a rotational force and drive the screw into the desired location without risk that the screw will detach from the driver. Subsequent to the desired placement of the screw, the swivel cap located on the driver may be translated away from the handle to release the screw from the tip. Further details of the present exemplary system and method will be provided below, with reference to the figures. While the figures and the detailed description provided below provide a clear understanding of the present system and method, it should be clear that the figures and description are according to various exemplary embodiments and do not limit the scope of the system and method in any way.

In the following description, certain specific details are set forth in order to provide a thorough understanding of various embodiments of the present system and a method for a locking driver and a corresponding screw. However, it will be recognized that the present exemplary system and method may be practiced without one or more of these specific details, or with other methods, components, materials, etc. In other instances, well-known structures associated with driving screws have not been shown or described in detail to avoid unnecessarily obscuring descriptions of the present exemplary embodiments.

Unless otherwise noted, throughout the specification and the appended claims, the word "comprise" and variations thereof, such as, "comprises" and "comprising" are to be construed in an open, inclusive sense, that is as "including, but not limited to."

Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment. Furthermore, the particular features, structures, or characteristics may be combined in any suitable manner in one or more embodiments.

Additionally, the term "screw" should be interpreted broadly to include any number of fastener devices including, but in no way limited to, a screw, a nut, a bolt, or any other fastener typically placed into a location by a translational force or by a rotation force (e.g. a pin can be pushed downward into place, and a bone screw can be rotated causing the threads to enter a bone).

A detailed description of the driver and its features, according to several exemplary embodiments, is provided below. As detailed below, the exemplary driver includes a handle, shaft, tip, a means to lock the tip to a screw, and a means to release the tip from a screw. A description of a screw is provided having a driving feature within the outer diameter of the head; advantages of such a screw and corresponding driver are described. Subsequently, several alternative embodiments of the present system and method are described. Various adaptations of the present system and method are possible to accommodate for a wide variety of screws and applications thereof.

Exemplary Structure

FIG. 1A provides a perspective view of an exemplary driver (100). As illustrated in FIG. 1A, the driver (100), according to one exemplary embodiment, includes a handle (130), a shaft (140), a cap (110), a lever (120), and a tip (150). Each of the exemplary elements of the driver (100) mentioned above will be described in detail in conjunction with FIG. 1A. However, it should be understood that FIG. 1A merely illustrates one exemplary embodiment and many variations are possible. To better understand the configuration of the driver (100), an overview of the function of the driver (100) will be given in the form of an exemplary use simultaneously with the description of each of the above-named elements.

With the driver (100) in an initial position as shown in FIG. 1A, the lever (120) is shown extending away from the handle (130). The lever (120), as shown in FIG. 1A according to one exemplary embodiment, is pivotably connected to the handle (130) by a pivot pin (122). Additionally, according to one exemplary embodiment, the lever (120) is also mechanically connected to the tip (150) internally via any number of linking member(s) or mechanism(s). According to one exemplary embodiment illustrated in FIG. 1A, the lever (120) is coupled to the tip (150) via a tip actuation linkage (125). According to the configuration illustrated in FIG. 1A, rotation of the lever (120) away from the handle (130) pulls the tip actuation linkage toward the shaft (140), thereby advancing the tip (150) and its accompanying linkage within the shaft. As the tip (150) extends beyond the end of the shaft (140), the tip is able to expand and/or move according to its geometric limitations. Conversely, when the lever (120) is rotated about the pivot pin (122) such that the lever (120) is placed against the handle (130), the tip actuation linkage (125) is drawn away from the shaft (140) causing the tip (150) and its accompanying linkage to recess further into the shaft (140). When recessed into the shaft (140), the tip (150) is forced into the internal diameter of the shaft (140), thereby compressing the tip. When the driver (100) is in an initial position, as shown in FIG. 1A, the driver is configured to receive a screw (200).

Figure 1B:
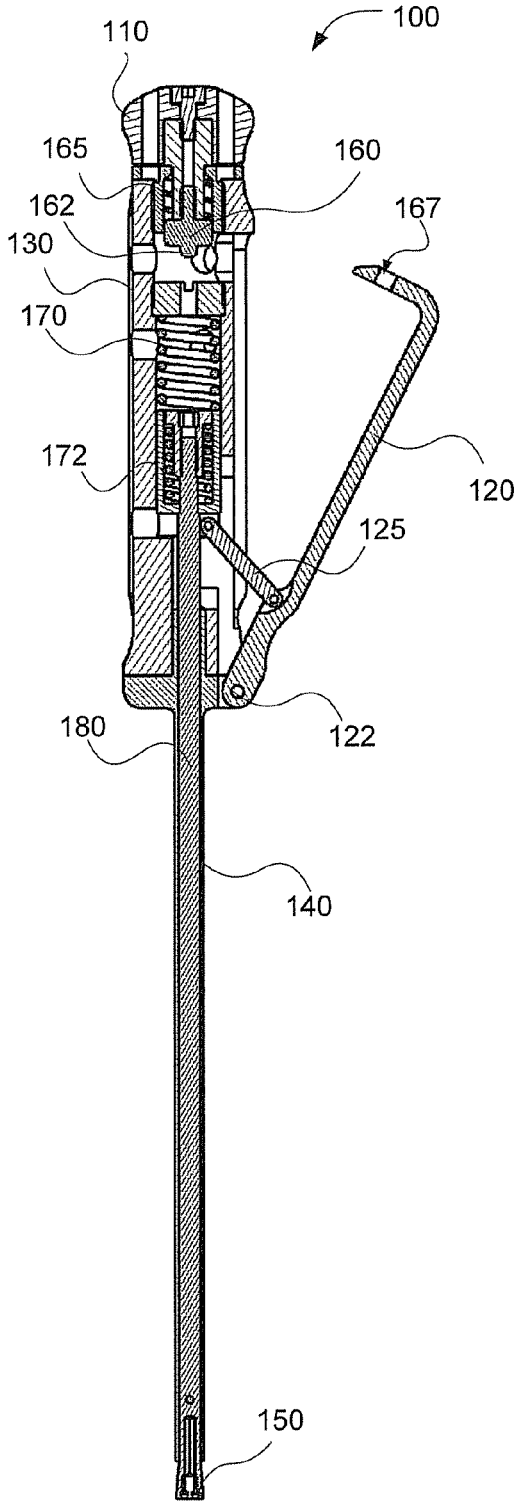
FIG. 1B is a side cross-sectional view of the driving instrument of FIG. 1A, according to one exemplary embodiment.

FIG. 1B illustrates a cross-sectional view of the driver (100) of FIG. 1, according to one exemplary embodiment. As illustrated in FIG. 1A, the cap (110) is formed within a center orifice of the handle (130). As shown, the cap (110) includes a protruding member that is retained within the center orifice of the handle (130) by a cap spring member (165). According to one exemplary embodiment, the cap spring member (165) retains the cap (110) in its illustrated location, while allowing for a proximal translation of the cap when a pulling force is exerted on the cap (110). Upon the exertion of a pulling force, the cap spring member (165) will be compressed until the force is released. Once the pulling force is released, the spring will exert a restoring force on the cap (110) and return it to its original position.

Continuing with the cap (110) construction illustrated in FIG. 1A, the cap terminates with a plunger member (160) having a lever engagement protrusion (162). Furthermore, as illustrated in FIG. 1A, the lever (120) includes a mating retention orifice (167) defined therein. According to one exemplary embodiment, when the cap (110) is in its natural position, as illustrated in FIG. 1A, the plunger member (160) having a lever engagement protrusion (162) are positioned such that the lever engagement protrusion will engage with the mating retention orifice (167) to retain the lever (120) when rotated flush with the handle (130).

Furthermore, FIG. 1A illustrates the internal components contained within the handle (130) and the shaft (140) to facilitate selective actuation of the tip (150). As illustrated, the tip actuation linkage (125) is rotatably coupled to an internal tip translation member (180), which terminates on a distal end at the tip (150). As shown, a bias is provided as a restoring force to the tip translation member (180) and the handle (120) via a plurality of springs (170, 172) selectively positioned on a proximal end of the internal tip translation member (180). Further details of the construction and operation of the exemplary driver (100) will be provided below.

Figure 2:
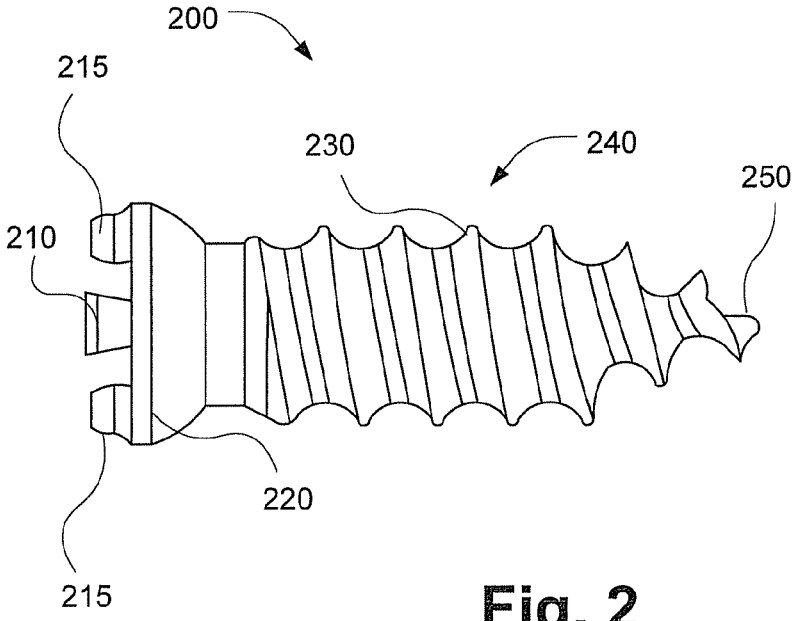
FIG. 2 is a side view of an exemplary screw containing a driving feature within the outer diameter of the screw head, according to one exemplary embodiment.

FIG. 2 illustrates an exemplary screw configured to mate with and be actuated by the driver of FIG. 1A. As illustrated in FIG. 2, the screw (200) includes, according to one exemplary embodiment, a head portion (220) and a shaft portion (240). As shown, a driving feature (210) is disposed on the head (220) of the screw. The screw (200) may have any number of additional driving features (215) used to drive the screw (200) when rotated. The head (220) is attached to a shaft (240) generally comprising threads (230) useful for penetrating the desired location. The screw (200) may also include a tip (250) on a distal end thereof. According to various alternative embodiments, the tip (250) may be flat or rounded. The screw (200) may alternatively be any one of a variety of fasteners mentioned above, including a self-taping bone screw.

Figure 3:
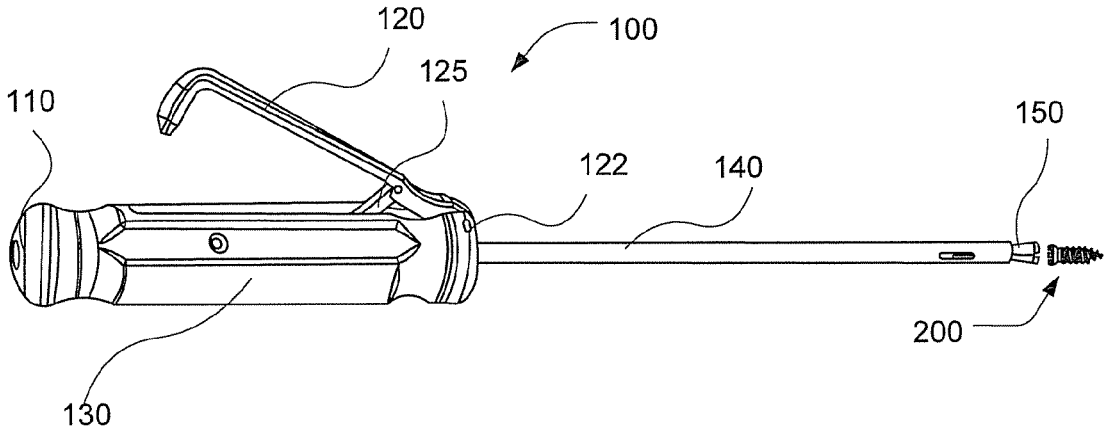
FIG. 3 is a view of a driving instrument prior to engaging a screw, according to one exemplary embodiment
Figure 4:
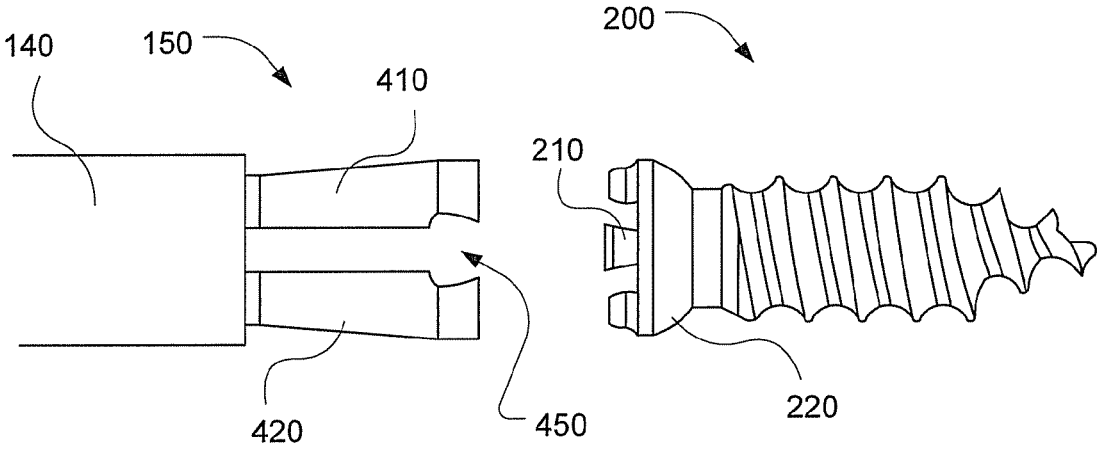
FIG. 4 is a close up view of the tip of the driving instrument of FIG. 3, according to one exemplary embodiment.

Proceeding to FIG. 3, according to one exemplary embodiment, the driver (100) is shown immediately prior to the securement of a screw (200). As shown, the lever (120) is extended causing the tip (150) to be open in a screw-receiving position. A close up view of the interaction between the tip (150) and the screw (200) is shown in FIG. 4. While FIG. 4 provides specific details of the configuration of the tip (150) and the head (220) of a screw (200), according to one exemplary embodiment, any number of modifications may be made on either the tip and/or the head of the screw to facilitate the interaction described herein. According to the exemplary embodiment illustrated in FIG. 4, the tip (150) extends from the shaft (140) due to a translational force imparted on it by the tip actuation linkage (125; FIG. 3) in response to a rotation of the lever (120; FIG. 3) about the pivot pin (122; FIG. 3). According to one embodiment, the tip (150) comprises two compressive tip members (410, 420), which, in the screw-receiving position, are separated and create an opening (450) configured to receive a driving feature (210) located on the head (220) of the screw (200). The tip (150) is configured to receive the driving feature (210) and subsequently secure the screw (200) preventing the release thereof until desired.

Figure 5:
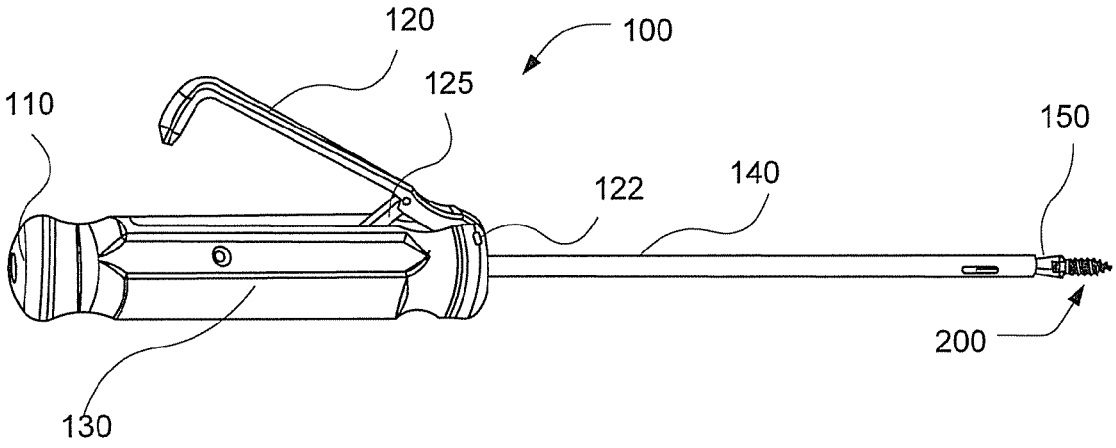
FIG. 5 is a view of a driving instrument engaging a screw, prior to locking onto the screw, according to one exemplary embodiment.

FIG. 5 illustrates the initial steps of securing a screw (200) within the tip (150) of the driver (100). It should be noted that the lever (120) is extended causing the tip (150) to remain in a screw-receiving position. While in this position, the exemplary screw (200) is then placed between the first compressive member (410) and the second compressive member (420). That is, the driving feature (210) of the screw (200) is placed within and received by the gap (450) defined by the compressive members (410, 420). The reception of the screw (200) is detailed in FIG. 6, which illustrates a close up view of the driver/screw combination shown in FIG. 5. According to one exemplary embodiment, while in this position (FIGS. 5 and 6) the screw (200) is not fully locked to the driver (100), but it is possible to rotate the driver (100) and drive the screw (200) into the desired location without the screw being fully locked. That is, some screw retaining compressive force may be imparted onto the screw (200) by the compressive members (410, 420) in the position illustrated in FIG. 6. This slight compressive force provides for initial retention of the screw (200). However, this screw retaining compressive force may be easily overcome to facilitate the selective release of the screw (200). The features (215, FIG. 2) on the head of the screw (200) are engaged by the tip (150) of the driver (100) even when a screw (200) is not fully locked within the tip (150) of the driver (100). According to alternative embodiments, it may be desirable to fully lock the screw (200) prior to being able to drive the screw (200).

Figure 6:
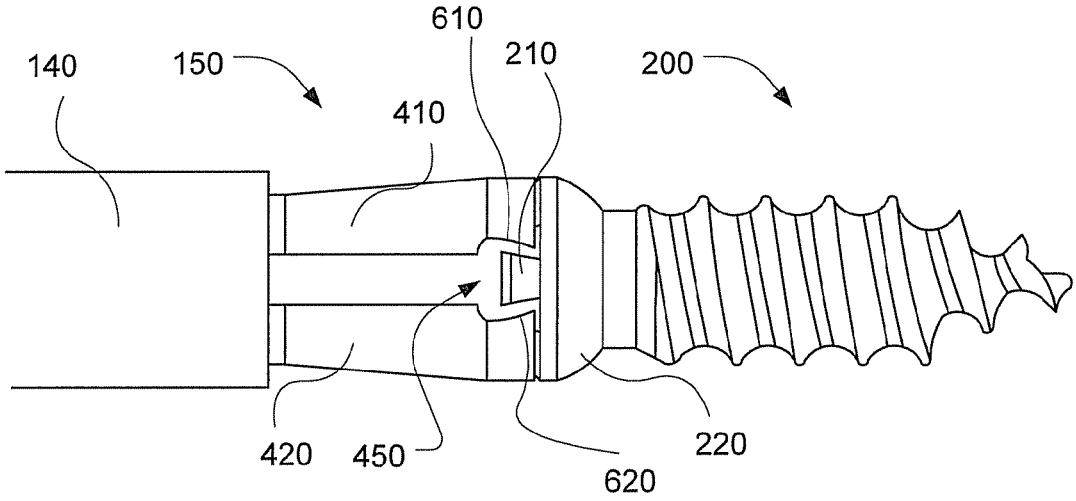
FIG. 6 is a close up view of the tip of the driver of FIG. 5 prior to locking onto the screw, according to one exemplary embodiment.
Figure 7A:
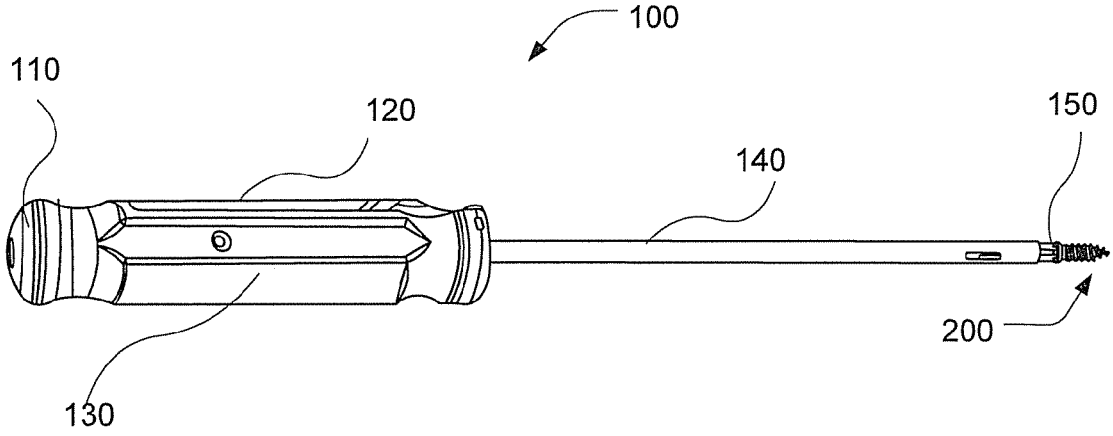
FIG. 7A is a view of a driving instrument locked onto the head of a screw, according to one exemplary embodiment.

Once the screw (200) is placed within the tip (150) of the driver (100), as shown in FIGS. 5 and 6, it is ready to be locked in place. FIG. 7A illustrates the present system in an engaged and locked configuration, according to one exemplary embodiment. In contrast to the screw reception position illustrated in FIG. 5, in FIG. 7A the lever (120) has been engaged, that is, it has been rotated about the pivot pin (122) such that the lever is substantially flush with the surface of the handle (130) and the lever engagement protrusion (162, FIG. 1B) is seated in the mating retention orifice (167; FIG. 1B).

Figure 7B:
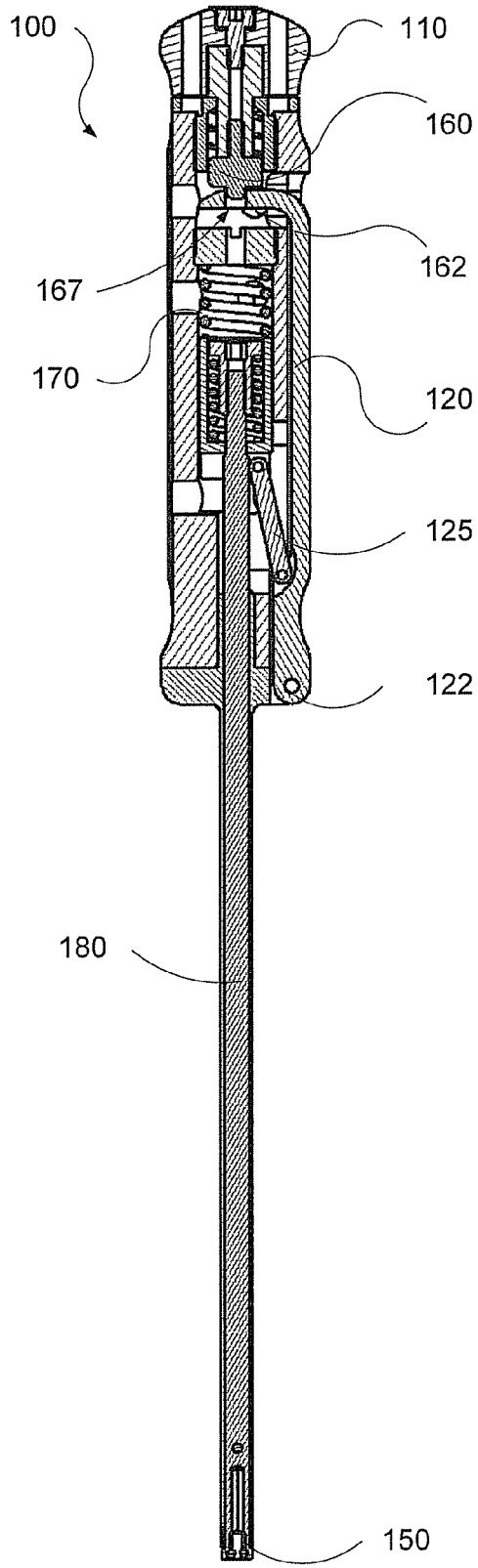
FIG. 7B is a side cross-sectional view of the driving instrument of FIG. 7A, according to one exemplary embodiment.

Further, as illustrated in FIG. 7B, the full rotation of the lever (120) engages the lever engagement protrusion (162) into the mating retention orifice (167) defined by the lever (120). According to one exemplary embodiment, engagement of the engagement protrusion (162) with the mating retention orifice (167) is facilitated by the translation of the cap (110). Alternatively, the plunger member (160) may be formed of a pliable material that deforms to receive the mating retention orifice. Furthermore, as illustrated in FIG. 7B, when the lever (120) is in the locked position, the internal tip translation member (180) is retracted, along with the tip (150), thereby compressing the spring (170).

As shown in the figures, the lever (120) is the actuation means by which the tip (150) is controlled and placed in either an open, screw-receiving position, or a closed, screw-securing position. Specifically, as illustrated above, rotation of the lever (120) about the pivot pin (122) such that the lever is substantially flush with the handle (130) selectively translates the tip actuation linkage (125), thereby retracting the coupled tip (150) into the shaft (140). Various alternative embodiments of the present exemplary system may utilize a variety of means to control the tip (150), it is not necessary to utilize exclusively a lever (120); alternative embodiments may include a button, a spring, a switch, a slide, or any combination of the previously mentioned items and the like in place of the lever (120).

Returning to FIG. 7A, it can be seen that the lever (120) has been rotated about the pivot pin (122) downward into the handle (130). According to the exemplary embodiment illustrated in FIG. 7A, rotation of the lever (120) retracts the tip actuation linkage (125), drawing the tip (150) into the internal diameter of the shaft (140). Specifically, the exemplary embodiment illustrated in FIG. 7A includes a tapered tip (150) which contracts against the internal surface of the shaft (140), thereby compressing and securing the screw (200) to the driver (100). The interaction with the tip (150) and the screw (200) can be best seen in FIG. 8.

Figure 8:
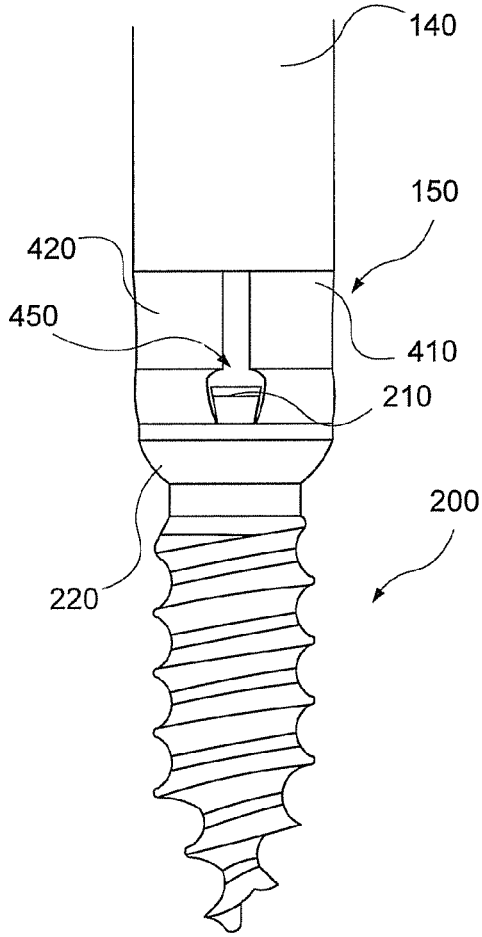
FIG. 8 is a close up view of the tip of FIG. 7A illustrating the tip of the driving instrument secured to the head of a screw, according to one exemplary embodiment.

As is illustrated in FIG. 8, the opposing compressive members (410, 420) contract in response to engagement of the lever (120). The compressive members (410, 420) compress the driving feature(s) (210) located on the head (220) of the screw (200). According to one exemplary embodiment, the compressive force imparted on the driving feature(s) (210) by the compressible members (410, 420) is sufficient to create a high level of friction, thereby fully locking the screw (200) to the driver (100). Additionally, according to alternative embodiments, as shown in FIG. 8, the driving feature (210) on the screw (200) may be tapered inward. In such an embodiment, the compressive plates (410, 420) may be configured with corresponding tapered ends (610, 620, FIG. 6). According to this embodiment, the tapered portions act to provide a better securement of the screw (200).

As shown in FIG. 7A, with the screw (200) secured to the driver (100), the screw (200) can now be easily driven into the desired location by rotating the driver (100). The handle (130) provides a convenient surface for rotating the driver (100). The shaft (140) is much thinner than the handle (140) allowing the screw (200) to be inserted within small openings. According to the exemplary embodiment illustrated throughout the drawings, a distinct advantage of the present system and method is that the tip (150) secures the screw (200) within the outer diameter of the head (220) of the screw (200). Consequently, according to various embodiments, the tip (150) and the shaft (140) are configured with a diameter equal to or smaller than the largest diameter of the screw (200). This provides several advantages over the prior art, especially in minimally invasive surgery (MIS) applications.

An exemplary application of the present system and method is one in which a screw must be placed within an opening wherein the opening is only as wide as the screw itself. In such an application it might be impossible to insert a traditional screwdriver and secure the screw. Furthermore, a traditional screwdriver cannot mechanically lock the screw to the driver. The present system and method allows the screw to be fully secured to the driver prior to the insertion of the screw while still maintaining the smallest possible diameter.

Figure 9:
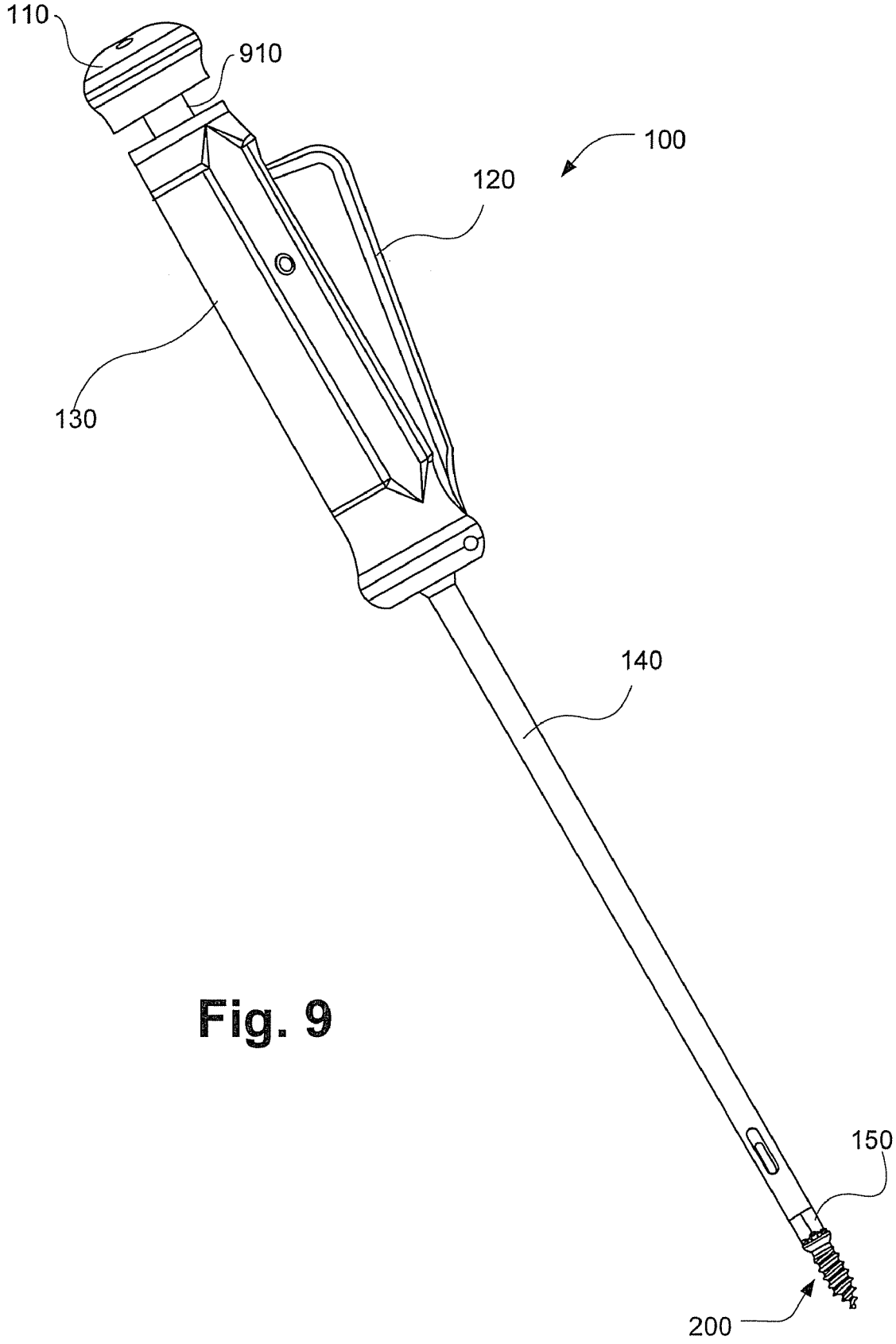
FIG. 9 illustrates the cap of a driving instrument translated away from the handle thereby releasing the lever and consequently releasing the screw, according to one exemplary embodiment.

As has been previously mentioned, according to one exemplary embodiment, the driver (100) is configured with a swivel cap (110) as is best illustrated in FIG. 9. According to one exemplary embodiment, the cap can be rotated independent from the handle (130), shaft (140), and tip (150). Particularly, according to one exemplary embodiment, the swivel cap (110) may be coupled to the driver by bearings or another friction eliminating device. This allows the screw (200) to be inserted with a jeweler style swivel cap. One advantage of such a swivel cap (110) is that the operator can provide a constant downward pressure while the handle (130) is rotated to drive a screw (200). Another advantage is the ease with which an operator can use the driver (100) with only one hand. With such a swivel cap (110) and driver (100) as has been described thus far, one-handed operation is trivial.

According to one exemplary embodiment, a cap, or a swivel cap (110) as is illustrated is also configured to provide a releasing means. When the cap (110) is translated away from the handle (130) (compare FIG. 1A and FIG. 9), the cap causes the lever (120) to be released. Particularly, according to one exemplary embodiment, the swivel cap (110) is coupled to the handle (130) by a spring loaded shaft (910) configured to maintain the swivel cap against the handle (130) until a pulling force is exerted on the swivel cap. The release of the lever (120) consequently allows the tip (150) to expand thereby releasing the screw (200). Accordingly, once the screw (200) has been driven into the desired location, the cap (110) can be pulled, translating the cap (110) away from the handle (130) and releasing the screw (200) from the tip (150). The driver (100) can then be easily removed from the location.

Clearly, if it is desired to remove a previously driven screw (200), the driver (100) can be inserted into the location with the tip (150) in an open, screw-receiving position, as is shown in FIG. 6. Once the tip (150) encounters the screw (200) the lever (120) can be engaged (see FIG. 7A) locking the screw to the driver and allowing the screw (200) to be removed.

Figure 10:
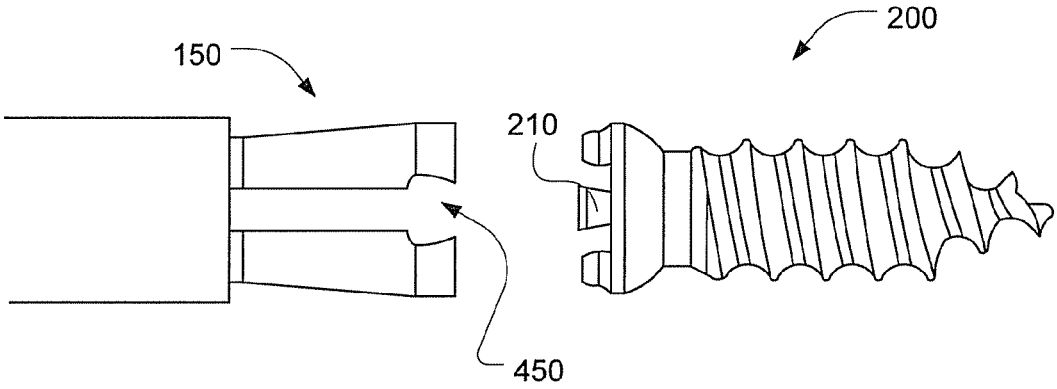
FIG. 10 illustrates the tip of a driving instrument and corresponding screw, according to one exemplary embodiment.
Figure 11:
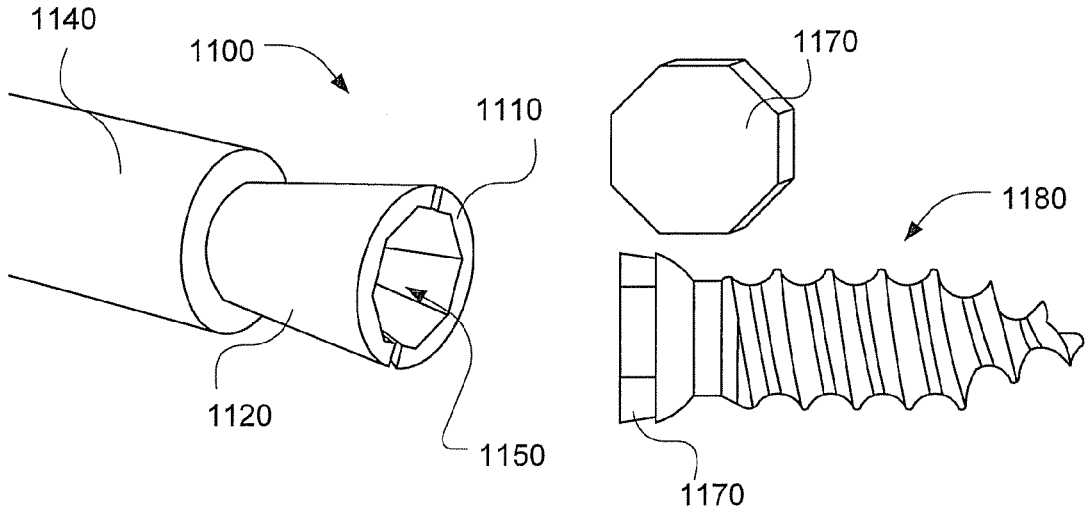
FIG. 11 illustrates the tip of a driving instrument and corresponding screw, according to one exemplary embodiment.
Figure 12:
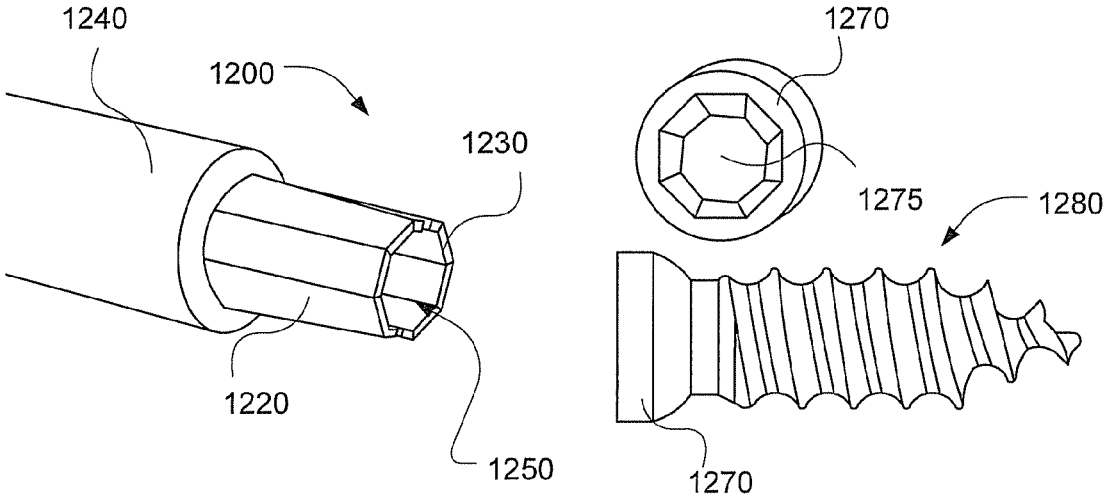
FIG. 12 illustrates the tip of a driving instrument and corresponding screw, according to one exemplary embodiment.

While the preceding description has closely followed the drawings and has presented several exemplary embodiments of the present system and method, many variations and adaptations are possible and likely desirable. FIGS. 10, 11, and 12 provide several alternative exemplary embodiments. While a vast number of readily obvious variations are possible, only two are shown. FIG. 10 is a close up view of a driver tip (150) and screw (200) similar to the one previously described. All of the previously described tip/screw head interactions have included a tip (150) that compresses a driving feature (210) within an outer diameter of the head of the screw (200). While this may be advantageous, it may also be desired to accommodate alternative screw types.

Shown in FIG. 11, according to one alternative exemplary embodiment, is a tip (1100) on the end of the shaft (1140) of a driver that could be configured similar to that of FIG. 1A. The tip (1100) according to the exemplary embodiment, shown in FIG. 11, is configured with two compressional sections (1120, 1110) that act to compress the outer perimeter of the head (1170) of a screw (1180). The screw (1180) is illustrated beside the tip (1100) in the illustration. As illustrated, this alternative embodiment includes an octagonal screw head; consequently the tip (1100) is configured with an opening (1150) having eight corresponding sides. The tip (1100) of FIG. 11 would function nearly identical to the driver previously described in conjunction with FIGS. 1-9. That is, an operator might insert the tip (1100) onto the head (1170) of the screw (1180), engage a lever thereby locking the screw (1180) within the tip (1100), and subsequently drive the screw (1180) into the desired location. Similar alternative embodiments might include various shapes that compress around the outer perimeter of the head of a screw; such as round, hexagonal, pentagonal, square, hexalobe, star, and other polygonal shapes. Furthermore, each of the corresponding screw heads may include tapered sides to enhance the engagement of the screw head.

Another alternative embodiment is illustrated in FIG. 12. According to this exemplary embodiment, the tip (1200) is configured to be inserted into an opening (1275) in the head (1270) of a screw (1280) and subsequently expand thereby locking the screw (1280) to the driver. The tip (1200) is shown as being configured to be inserted into an octagonal opening as is illustrated (1275). According to this exemplary embodiment the tip (1200) is inserted into the opening (1275). Once the tip (1200) is within the opening (1275), the lever is engaged causing the tip (1200) expand within the opening (1275). The opposing plates (1220, 1230) expand against the internal walls of the opening (1275) creating an interference fit and locking the screw (1280) to the driver. The driver can then be rotated to drive the screw (1280) into a desired location.

The preceding description includes several variations of the system and method according to various embodiments; however, it should be obvious to one of ordinary skill in the art that many more variations are possible. A driver configured with a tip capable of locking a screw to the driver by either compressing an outer perimeter of the screw, expanding within a cavity in the screw, or compressing a driving feature within an outer diameter of the screw can be configured with any number of shapes or tapers to facilitate both locking the screw to the driver and/or driving the screw into a desired location.

According to one alternative embodiment, as has been previously discussed, the means to actuate the tip may include various alternative actuators and not exclusively a lever. Additionally, the means to release the lever and the tip is described in FIGS. 1-9 as being a swivel cap. Alternative embodiments may or may not include a cap of any sort. Alternative means to release the lever could include, pulling the lever itself, a button, a switch or any other conceivable means. A swivel cap may be present that is not used to release the lever, but is exclusively used to provide jeweler style rotation.

Additionally, as previously discussed, while the preceding description specifically discusses a screw, an obvious substitution can be made incorporating a bolt, nut, or other fastener. Consequently, depending on the fastener used, it may not be necessary to rotate the driver to insert the fastener. For example, in the event a pin is used, the pin may be secured to the driver in any one of the manners described above and subsequently driven into a desired location with or without rotation of the driver. The novelty of simply securing the pin or other fastener to the driver may be advantageous for a specific application. Specifically, the novelty of securing a fastener of any type within a largest diameter of the fastener may be advantageous in that the diameter of the driver, or a portion of it, can be as small or smaller than the diameter of the fastener.

The above detailed description of the elements of the present system according to various exemplary embodiments is provided to allow one of reasonable skill in the art to appreciate the novelty of the system. Below is found a description of one exemplary method and is exemplified in the flow diagram of FIG. 13. Throughout the description the identifying numbers refer to FIGS. 1-9, while it should be apparent that the alternative embodiments described, and those that are not, may be used with slight modifications to the exemplary method found below.

Exemplary Method

Figure 13:
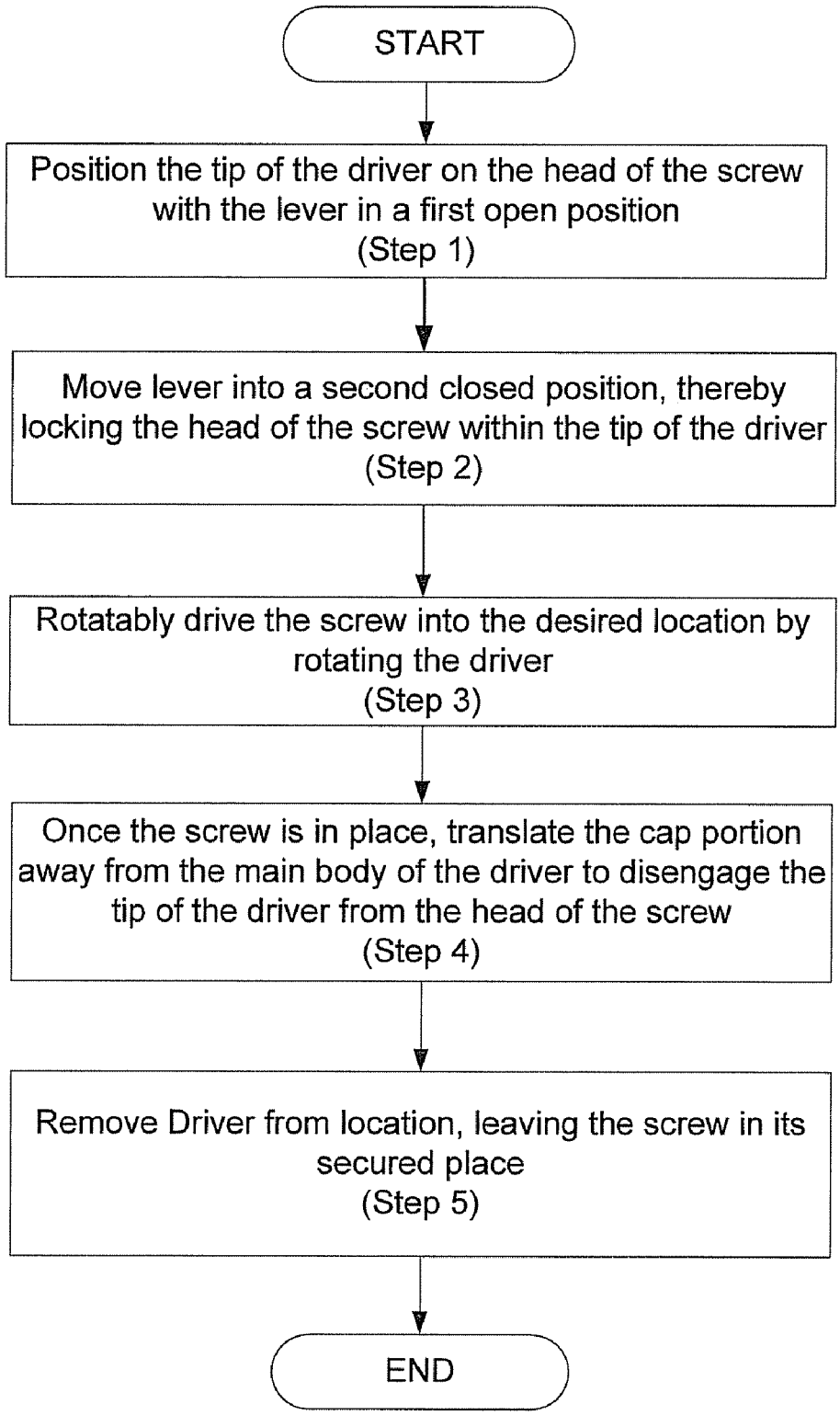
FIG. 13 is a flow chart illustrating a method of securing a driving instrument to the head of a screw, driving a screw, and releasing the head of the screw, according to one exemplary embodiment.

As is shown in FIG. 13, according to one exemplary embodiment, the tip (150) of a driver (100) is positioned on the head (220) of a screw (200) with a lever (120) or other tip-actuating means in a first open position (Step 1, FIG. 5). By moving the lever (120) or other tip-actuating means into a second closed position, the tip (150) contracts around a driving feature located on the screw (200) creating an interference fit and thereby locking the screw (200) to the tip (150) of the driver (100). According to various embodiments the driving feature may include an outer perimeter (see FIG. 11) of the head (220) of the screw (200), a driving feature (210) within an outer diameter of the head (220) of the screw (200), or alternatively the tip (1250) may expand within a cavity (1270) and thereby lock the head (1270) of a screw (1280) to the tip (1200). Regardless, the tip (150) engages and locks a screw (200) to the driver (100) (Step 2, FIG. 7A). According to several embodiments, the tip (150) includes tapered portions (610, 620) to assist in fully securing the screw, the screw (200) contains tapered portions (210) for the same purpose, or both the screw (200) and the tip (150) contain tapered portions.

The driver (100) is now ready to drive a screw (200) into a desired location. The driver (100) may be rotated to drive a threaded screw (200), or alternatively it might be simply pushed into a location inserting a fastener of another type into the desired location, such as a pin. According to several exemplary embodiments, the driver (100) is configured with a swivel cap (110) allowing an operator to use the driver in a jeweler style manner (Step 3).

With the screw (200) inserted into the desired location, the lever (120), or other tip-actuating means, can be disengaged (see FIG. 9). The disengagement of the lever (120) causes the tip (150) to release the screw (Step 4). The driver (100) can now be removed leaving the screw (200) in the desired location (Step 5). According to one exemplary embodiment, the lever (120) is disengaged by translating the swivel cap (110) away from the handle (130) of the driver (100) (see FIG. 9). Alternatively the lever (120) or other tip-actuating means might be disengaged by any number of lever-releasing means.

According to one alternative embodiment, the driver (100) is configured to accommodate various tips, each being configured to interact with specific screws. According to this embodiment, a plurality of tips may be interchangeably used with a single driver.

According to alternative embodiment, the driver (100) may be configured with internal mechanisms allowing only a specific or user specified torque to be applied to the screw. This is common in a typical torque wrench and would be an obvious modification to the present exemplary system and method. Alternatively the screw (200) may be configured with driving features that only allow a specific torque to be applied. According to one exemplary embodiment, the screw's driving features could break at a specifically engineered torque. Because the driver locks onto the broken portion, the screw would be driven into the location at the specified torque and upon removal of the driver the broken piece(s) would be removed.

According to one embodiment, tapered portions of either the tip (150) of the driver or the driving feature(s) on the screw (200) are configured in such a way so as to provide a sufficient surface for locking the screw to the driver only up to a specified torque. That is, at a certain torque the interference fit created by the tip and the driving features will be insufficient to secure the screw to the driver; the amount of torque necessary to reach such a breakpoint may be tailored for specific applications.

In conclusion the present exemplary system and method provide for a locking driver capable of locking a screw and driving the screw into a desired location. The present system and method may be configured according to various exemplary embodiments; however, according to one embodiment, the driver secures the screw within an outer perimeter of the screw. Consequently, the driver, or a portion of it, may have a perimeter equal to or smaller than the greatest diameter of the screw. This is particularly useful for minimally invasive surgery (MIS). According to one exemplary embodiment the driver is configured for one-handed use.

The preceding description has been presented only to illustrate and describe the present method and system. It is not intended to be exhaustive or to limit the present system and method to any precise form disclosed. Many modification and variations are possible in light of the above teachings.

The foregoing embodiments were chosen and described to illustrate principles of the system and method as well as some practical applications. The preceding description enables others skilled in the art to utilize the method and system in various embodiments and with various modifications as are suited to the particular use contemplated. It is intended that the scope of the present exemplary system and method be defined by the following claims.

What is claimed is:

1. A screwdriver comprising:

a handle having a proximal end and a distal end;

a shaft including a proximal end and a distal end, wherein said proximal end of said shaft is coupled to said distal end of said handle;

a cap member disposed on said proximal end of said handle;

a tip disposed on said distal end of said shaft;

an actuation member disposed on said handle, wherein said actuation member is configured to selectively actuate said tip, transitioning said tip from a locked position to an unlocked position;

a retention orifice defined on said actuation member; and a protrusion disposed on a distal end of said cap member;

wherein said cap member is configured to engage said actuation member via said retention orifice when engaged; and wherein said cap member is configured to release said actuation member from an engaged position when said rotatable cap is slidably translated from said handle.

2. The screwdriver of claim 1 wherein said cap member comprises a rotatable cap disposed on said proximal end of said handle, said rotatable cap being configured to independently rotate with respect to said handle.

3. The screw driver of claim 2, further comprising a torque gauge incorporated in said screw driver.

4. The screwdriver of claim 1, wherein said actuation member is configured to selectively retract and advance said tip; and wherein said tip includes an outer taper;

wherein said selective retraction of said tip into said shaft compresses said tip.

5. The screwdriver of claim 1, in combination with a fastener, wherein said tip is configured to compress about a feature of said fastener.

6. The screwdriver of claim 5, wherein said fastener further comprises a head portion having a maximum diameter;

wherein said fastener feature is disposed within said maximum diameter of said fastener.

7. The screwdriver of claim 6, wherein said shaft further comprises a largest diameter;

wherein said tip includes a largest diameter; and wherein said largest diameter of said shaft and said largest diameter of said tip are both at least as small as said maximum diameter of said fastener.

8. The screwdriver of claim 1, in combination with a fastener, wherein said actuation member is configured to selectively cause said tip to expand and contract;

wherein said tip is configured to expand within a feature of said fastener to secure said fastener to said tip.

9. The screwdriver of claim 1, wherein said tip is configured to couple with at least one feature of a fastener.

10. The screwdriver of claim 9, wherein said tip compressively engages said feature to secure said fastener to said tip.

11. The screwdriver of claim 9, wherein said tip is configured to expand within said feature to secure said fastener to said tip.

12. A screwdriver comprising:

a handle having a proximal end and a distal end;

a shaft including a proximal end and a distal end, wherein said proximal end of said shaft is coupled to said distal end of said handle;

a tip translation member including a proximal and a distal end slideably positioned within said shaft;

a tip disposed on said distal end of said tip translation member proximate said distal end of said shaft, said tip being movable from a locked position to an unlocked position;

an actuation member pivotably disposed on said handle, said actuation member rotatably coupled to said proximal end of said tip translation member;

a retention orifice defined on said actuation member; and a protrusion disposed on a distal end of a cap member disposed on said proximal end of said handle;

wherein said protrusion is configured to releaseably couple with said retention orifice to secure or release said actuation member, and wherein said actuation member is configured to selectively actuate said tip, via said tip translation member, between said locked position and said unlocked position.

13. The screwdriver of claim 12, wherein said actuation member is configured to selectively retract and advance said tip in relation to said shaft;

wherein said tip includes an outer taper; and wherein said selective retraction of said tip into said shaft compresses said tip in a locked position.

14. The screwdriver of claim 12, wherein said tip is configured to couple with at least one feature of a fastener.

15. The screwdriver of claim 14, wherein said tip compressively engages said feature to secure said fastener to said tip.

16. The screwdriver of claim 14, wherein said tip is configured to expand within said feature to secure said fastener to said tip.

17. The screwdriver of claim 12, wherein said actuation member is rotatable between a first position and a second position, wherein in said first position said tip is in said unlocked position and in said second position said tip is in said locked position.

18. The screwdriver of claim 12, wherein said tip comprises two or more tip members.

* * * * *